US005687872A

United States Patent [19]

Nmngani

[11] Patent Number: 5,687,872

[45] Date of Patent: Nov. 18, 1997

[54] LIQUID CONTAINER INCLUDING AT LEAST ONE INTEGRAL STRAW

[76] Inventor: Abdulatif M. T. Nmngani, P.O. Box 13925, Jeddah, Saudi Arabia, 21414

[21] Appl. No.: 657,201

[22] Filed: Jun. 3, 1996

Related U.S. Application Data

[62] Division of Ser. No. 243,706, May 17, 1994, Pat. No. 5,522,524.

[51] Int. Cl.[6] ..... B65D 5/72

[52] U.S. Cl. ..... 220/710; 215/389; 220/707; 229/103.1

[58] Field of Search ..... 215/309, 389; 220/703, 705, 707, 710, 269, 270; 229/103.1

[56] References Cited

U.S. PATENT DOCUMENTS

| | | | |
|---|---|---|---|
| 2,432,132 | 12/1947 | Allen | 215/79 |
| 2,957,614 | 10/1960 | Krajcovic | 229/103.1 |
| 3,349,987 | 10/1967 | Weitzner . | |
| 3,362,607 | 1/1968 | Weitzner | 229/103.1 |
| 3,840,153 | 10/1974 | Devlin | 222/146 |
| 4,080,989 | 3/1978 | Chapelsky et al. . | |
| 4,165,814 | 8/1979 | Seel | 215/229 |
| 4,244,477 | 1/1981 | Seel | 215/229 |
| 4,269,332 | 5/1981 | Conn | 222/475 |
| 4,291,814 | 9/1981 | Conn | 229/90.4 |
| 4,407,425 | 10/1983 | Combs | 220/269 |
| 4,462,503 | 7/1984 | Di Raffaele et al. | 220/707 |
| 4,462,544 | 7/1984 | Rutzel et al. | 239/33 |
| 4,582,213 | 4/1986 | Park et al. | 220/707 |
| 4,700,861 | 10/1987 | Neward | 215/309 |
| 4,712,702 | 12/1987 | Ayabe et al. | 220/707 |
| 4,714,173 | 12/1987 | Ruiz | 220/90.4 |
| 4,715,359 | 12/1987 | Ryo . | |
| 4,830,204 | 5/1989 | Lin | 215/1 A |
| 4,911,315 | 3/1990 | Shrum | 215/229 |
| 5,054,631 | 10/1991 | Robbins, III | 215/1 A |
| 5,116,105 | 5/1992 | Hong | 229/103.1 |
| 5,188,283 | 2/1993 | Gu | 220/707 |
| 5,242,079 | 9/1993 | Stephens et al. | 220/705 |
| 5,409,131 | 4/1995 | Phillips et al. | 220/717 |
| 5,522,524 | 6/1996 | Nmngani | 229/103.1 |

FOREIGN PATENT DOCUMENTS

| | | | |
|---|---|---|---|
| 5229573 | 9/1993 | Japan | 220/707 |

*Primary Examiner*—Gary E. Elkins
*Attorney, Agent, or Firm*—Joseph W. Berenato, III

[57] ABSTRACT

A liquid container including at least one integral straw is disclosed. The liquid container includes a hollow container having a top, a bottom, and a side wall with the walls forming an interior space for containing a liquid. The first aperture is formed in one of the walls. A first hollow conduit is positioned within the first aperture and has an upper portion extending outside the container and a lower portion terminating proximate the bottom of the container. The conduit has a first L-shaped configuration in which a portion of the conduit is collapsed and forms a seal. A second aperture is formed in one of the walls as the first aperture. Sealing means are provided for sealing the second aperture. A key operatively connected to the upper portion is provided for causing the first conduit to be shifted from the L-shaped configuration to a second open configuration and for simultaneously breaking the sealing means and opening the second aperture.

8 Claims, 3 Drawing Sheets

Fig. 7
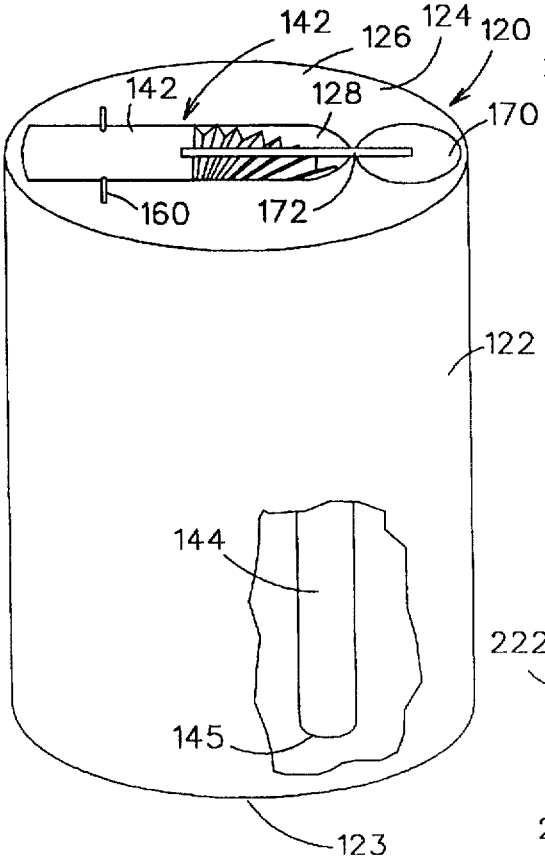
Fig. 9
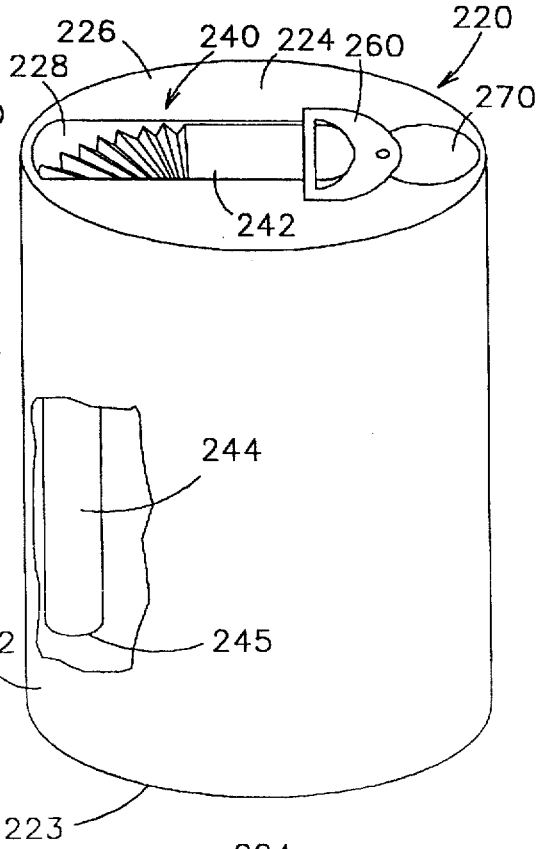
Fig. 10
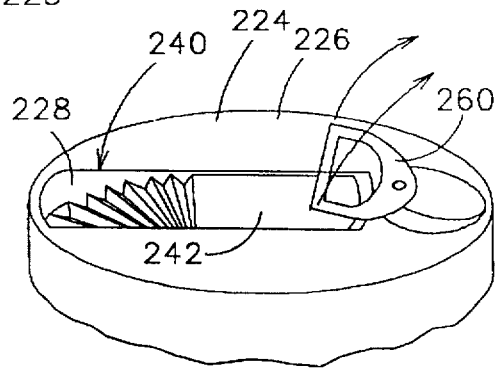
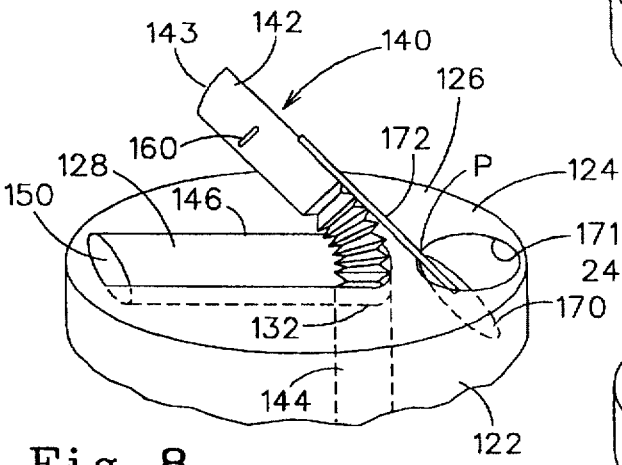
Fig. 8
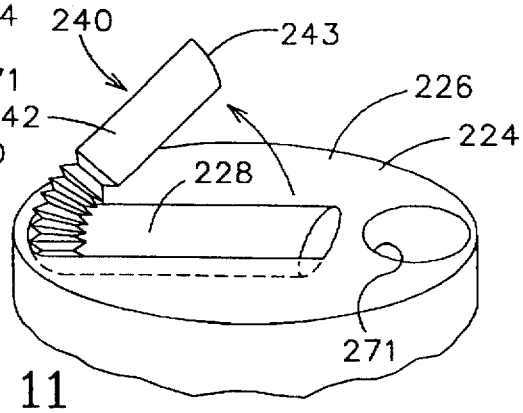
Fig. 11

LIQUID CONTAINER INCLUDING AT LEAST ONE INTEGRAL STRAW

This is a division of application Ser. No. 08/243,706, filed May 17, 1994, now U.S. Pat. No. 5,522,524.

BACKGROUND OF THE INVENTION

1. Field of the Invention

The present invention relates generally to liquid containers and, more particularly, to liquid containers including at least one integral straw which facilitates the withdrawal of liquid contained therein.

2. Description of the Prior Art

Liquid containers having integral or "built-in" straws are known in the prior art. For example, U.S. Pat. No. 3,349,987 discloses a beverage container having an interior divided into two sections, with each section having an integral straw. The distal ends of the two straws are sealed together and can be severed by a detachable tab. A vent is provided for each section by a push in tab. This arrangement, however, does not provide a vent which opens in conjunction with the straws.

U.S. Pat. No. 2,432,132 discloses a beverage container having an integral drinking tube and vent. This patent does not provide sealed integral straws, and instead provides a separate removable cap for sealing the container.

U.S. Pat. No. 4,407,425 discloses a container in which the pull-tab is used to open the container and expose an integral straw. This device does not provide a vent for facilitating withdrawal of liquid from the container.

U.S. Pat. No. 4,291,814 is of interest because it discloses a beverage container having a recess for receipt of an integral drinking tube.

It can be appreciated that liquid containers in the prior art have not previously provided built-in straws which are self-sealing, protected from damage during shipment, and convenient to use because the container is vented in conjunction with movement of the built-in straw into position where liquid can easily be sucked upwardly through the straw or poured therefrom.

As such, it may be appreciated that there is a continuing need for a new and improved liquid container including at least one integral straw as set forth by the present invention which addresses both the problems of convenience of use and effectiveness in construction, and in this respect, the present invention substantially fulfills these needs.

OBJECTS AND SUMMARY OF THE INVENTION

It is, therefore, an object of the present invention to provide a product satisfying the above-mentioned needs.

It is another object of the present invention to provide a liquid container having at least one integral straw which is simple in construction, effective in use and economical to manufacture.

These objects are achieved by providing a hollow container having walls, with the walls forming an interior space for containing a liquid. A first aperture is formed in one of the walls. A first hollow conduit extends through the first aperture and has an upper portion extending outside the container and a lower portion extending to near the bottom of the container. The conduit has an L-shaped position in which a portion of the conduit is collapsed such that a seal is created preventing communication therethrough between the atmosphere and the interior space of the container. A second aperture is formed in the same wall as the first aperture. Sealing means are provided for sealing the second aperture. Manually moveable means are provided for selectively severing the sealing means so as to permit communication between the atmosphere and the interior of the container through the second aperture, and for allowing movement of the first conduit from the L-shaped position so as to permit communication therethrough such that liquid can either be drawn through the first conduit when the container is in an upright position or liquid can be poured through the second aperture and gas in the container permitted to vent through the first conduit when the container is in an inverted position.

These and other objects of the present invention will become apparent from the following detailed description and appended claims.

The invention may best be understood with reference to the accompanying drawings wherein the illustrative embodiments are shown.

BRIEF DESCRIPTION OF THE DRAWINGS

FIG. 7 is a perspective view with portions broken away of a liquid container having an integral straw according to a third embodiment of the present invention showing a first conduit in an L-shaped position and a second aperture sealed;

FIG. 8 is a fragmentary perspective view of the liquid container of FIG. 7 showing the conduit having been moved from the L-shaped position and the second aperture being opened;

FIG. 9 is a perspective view with portions broken away of a fourth embodiment of the present invention showing a first conduit in an L-shaped position and a second aperture sealed;

FIG. 10 is a fragmentary perspective view of the liquid container of FIG. 9, showing a tab being moved from a closed position thereby opening the second aperture and allowing the first conduit to move from the L-shaped position; and FIG. 11 is a fragmentary perspective view of the liquid container of FIG. 10, showing the first conduit having been fully moved from the L-shaped position and the tab removed.

DETAILED DESCRIPTION OF THE INVENTION

Figure 1:
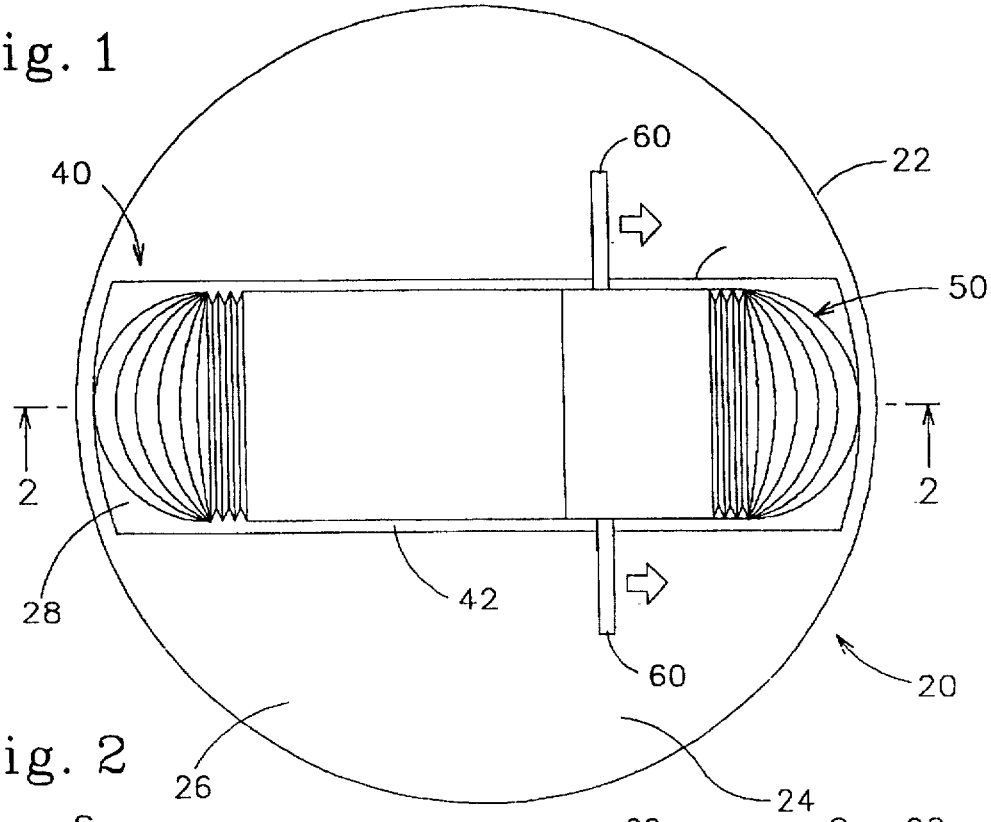
FIG. 1 is a top plan view of a liquid container having two integral straws according to a first embodiment of the present invention showing the first and second conduits each in an L-shaped position.
Figure 2:
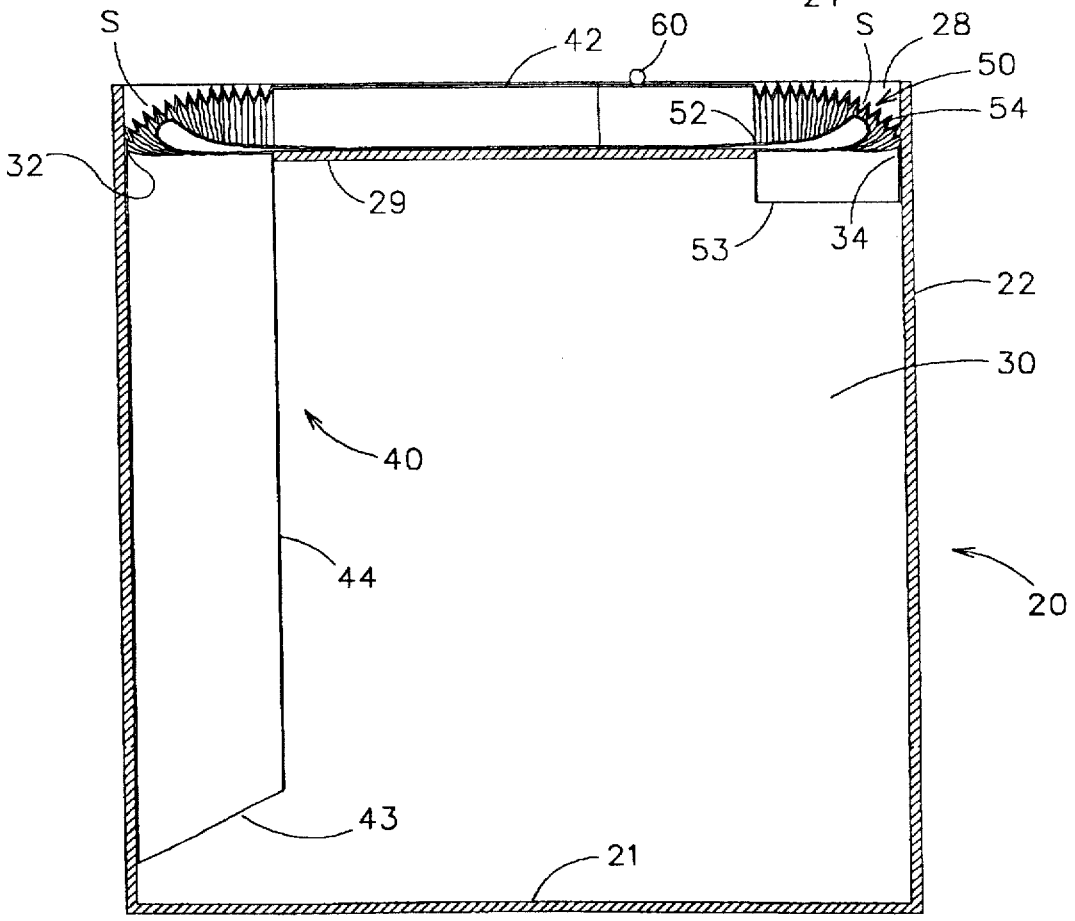
FIG. 2 is a cross sectional taken along line 2—2 of the liquid container of FIG. 1 showing the liquid container in an upright position.

Referring first to FIGS. 2, 7 and 9, there is shown therein a liquid container having at least one integral straw which is constructed in accordance with the principles of the present invention. In the drawings, the liquid container is shown in an upright position in FIGS. 1–4 and 6–11 and in an inverted position in FIG. 5. For convenience, the liquid container will be described in relation to the upright orientation, except when referring to FIG. 5, and consequently terms such as "above," "upwardly," and "bottom," etc. as used herein are to be construed in the relative sense.

In each of the embodiments illustrated, a container is provided to hold a liquid, such as a beverage, to be drawn or sucked from the interior space of the container. Alternatively, the container may hold a liquid that would typically be poured from the container, such as motor oil. While the particular integral straw configurations that will be disclosed herein may be applicable to a wide variety of container shapes, the exemplary embodiments disclose use of the invented integral straw configuration as part of a cylindrical container.

Liquid container product 20 includes a cylindrical container 22 as best shown in FIGS. 1 and 2. Container 22 is formed of a suitable material, such as a metal or a plastic. Container 22 has on its upper end a lid or wall 24 of like material. Wall 24 is in sealed relation with an outer edge of the cylindrical wall of container 22. Such sealing is important in order to insure a fluid tight seal, which is particularly important when the contained liquid is a pressurized carbonated beverage. Wall 24 has a top surface 26 in which recess 28 is formed. Recess 28 extends downwardly from top surface 26, as best shown in FIG. 2, and extends diametrically across wall 24 to the outer peripheries of wall 24. The cylindrical walls of container 22 and lid 24 form an interior space 30 wherein a liquid can be contained. Formed within recess 28 is a first aperture 32 and a second aperture 34, both of which are radially offset with respect to a longitudinal axis of container 22.

An integral built-in straw or first conduit 40, formed of a suitable flexible material such as paper or plastic, extends through first aperture 32 and has an outer circumferential surface sealed and secured thereto. First conduit 40 has an upper portion 42 spaced above first aperture 32, and a lower portion 44 extending downwardly relative to wall 24. A distal end 43 of lower portion 44 is spaced in close proximity to the bottom surface of container 22, enabling a user to draw most of the liquid within container 22 through straw 40 when container 22 is in an upright position. A second integral built-in straw or conduit 50, formed of a similar material, extends through second aperture 34, and has an outer circumferential surface sealed and secured thereto. Second conduit 50 has an upper portion 52 extending upwardly from second aperture 34, and a lower portion 54 extending slightly below upper surface 29.

As best shown in FIG. 2, first straw 40 and second straw 50 are each bent into an L-shaped configuration, so that a portion of straws 40 and 50 are collapsed and a seal S is created in each straw preventing communication through either straw between the atmosphere and interior space 28 of the container. As best shown in FIG. 2, upper portions 42 and 52 are coaxial, and are overlapped with one being slid within the other. A circumferential seal is thereby formed between the outer peripheral surface of one of the conduits and an inner peripheral surface of the other of the conduits. Glue or other means may be applied to reinforce the circumferential seal provided by the interfitting of straws 40 and 50. This circumferential seal provides a secondary seal in the event that either seal S should fail.

As best shown in FIGS. 1 and 2, product 20 is in a closed condition with upper portions 42 and 52 folded over so that a majority of their lengths are substantially parallel with top surface 26. Upper portions 42 and 52 are disposed within recess 28 so that they will be protected from shipping damage due to adjacent containers.

Key 60 is fixedly secured to upper portion 52 of second conduit 50. Key 60 is in the form of two rods which are transversely attached to the periphery of upper portion 52 and extend outwardly therefrom. As shown, the rods are coaxial with each other.

Figure 3:
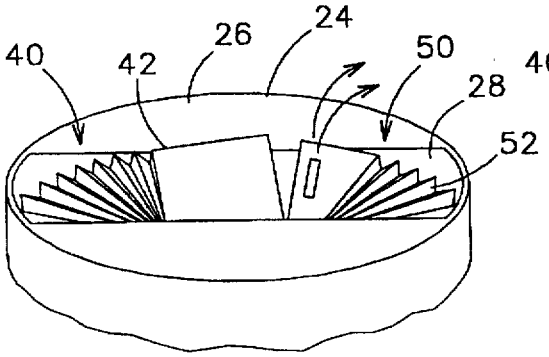
FIG. 3 is a fragmentary perspective view of the liquid container of FIG. 1 showing the first and second conduits being moved from the L-shaped position.
Figure 4:
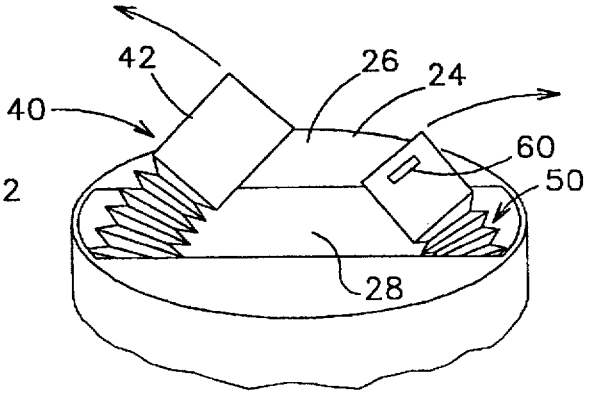
FIG. 4 is a fragmentary perspective view of the liquid container of FIG. 3 showing the first and second conduits separated from each other.
Figure 5:
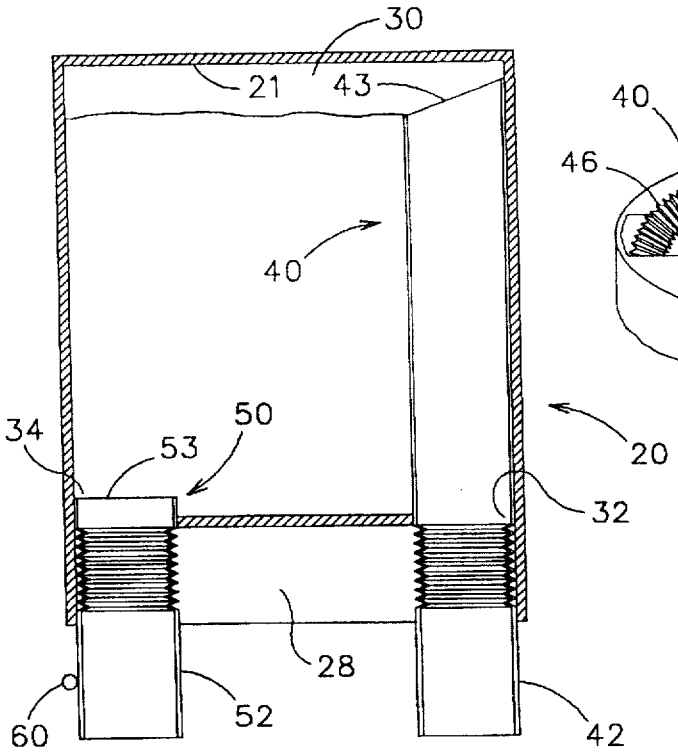
FIG. 5 is a cross sectional view of the liquid container of FIG. 2 in an inverted position with the first and second conduits unsealed and with liquid being poured through the second conduit.

In operation, to open container 22, key 60 is manually grasped and pulled upwardly away from top surface 26. The movement of key 60 causes second conduit 50 to change from the L-shaped position and first conduit 40 to begin to move from the L-shaped position. The change from the L-shaped positions renders seals S ineffective so that fluid may flow through conduits 40 and 50. Further movement causes second conduit 50 to separate from first conduit 40 as best shown in FIGS. 3 and 4. Continued upward pressure on key 60 severs the circumferential seal between upper portion 42 and upper portion 52. After the circumferential seal has been broken, first conduit 40 and second conduit 50 can be conveniently positioned to facilitate the withdrawal of the liquid content. The liquid within container 22 can now either be drawn through straw 40, as best shown in FIG. 4, or container 22 inverted and liquid poured through second conduit 50 as best shown in FIG. 5. Dual capability of container 22 is enhanced because end 42 of straw 40 is proximate bottom 21 of container 20, while end 53 extends slightly below surface 29. Thus, end 53 acts as a vent when straw 40 is used to remove the liquid, and end 43 acts as a vent when container 20 is inverted for liquid removal through straw 50.

Figure 6:
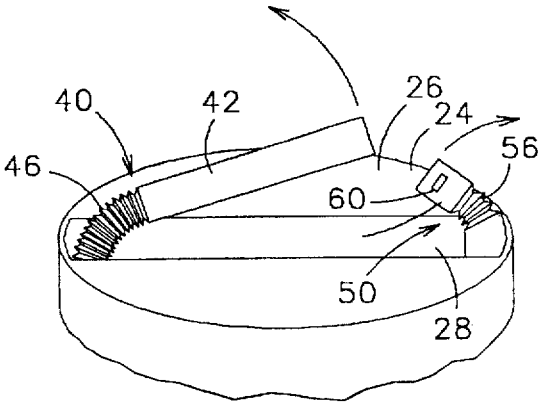
FIG. 6 is a fragmentary perspective view of a second embodiment of the liquid container according to the present invention showing the straws each having a flexible portion disposed outside the liquid container.

Alternatively, as best shown in FIG. 6, upper portions 42 and 52 can each be provided with a flexible portion 46 and 56. Flexible portions 46 and 56 are accordion-type hinges spaced above top surface 26 and below an upper terminal or distal end of the respective straw. These flexible portions allow the distal end of the straws to be easily positioned for use. Flexible portions 46 and 56 may, however, prevent seals S from being liquid tight, so that the circumferential seal between the interfitted ends 42 and 52 will probably require reinforcement by glue, bonding or the like.

A second embodiment of the present invention is best shown in FIGS. 7 and 8 and discloses a product 120 similar in construction to product 20. Product 120 includes a container 122, constructed from a suitable plastic or metal material, and an upper lid or wall 124 constructed of like material. Top surface 126 of wall 124 includes a recess 128. Wall 124 is in sealed relation with an outer edge of the cylindrical wall of container 122. Recess 128 extends from slightly off the diametrical center of wall 124 to almost the periphery of wall 124. The cylindrical wall of container 122 and lid 124 form an interior space 130 wherein a liquid can be contained. An aperture 132 is formed in wall 124 and is located at an end of recess 128 closest to the diametrical center of wall 124.

A conduit or straw 140, formed of a suitable flexible material of paper or plastic, has a portion positioned within aperture 132 and the outer peripheral surface sealed and secured thereto. Straw 140 has a lower portion 144 extending downwardly from aperture 132 and has an upper portion 142 extending upwardly from aperture 132. A distal end 145 of lower portion 144 is in close proximity to the bottom 123 of container 122. Upper portion 142 can also have a hinged portion as prescribed previously. A terminal end 143 of upper portion 142 is beveled. A seal 150 of a suitable resilient material, such as rubber, is securely positioned within recess 130 and has an inclined surface shaped to seal with beveled edge 143. As best shown in FIG. 7, straw 140 is bent into an L-shaped position, as previously described, thereby sealing straw 140. In this L-shaped position, the beveled end of straw 140 and the inclined surface of seal 150 cooperate so as to form a secondary seal.

Key 160 is transversely and fixedly attached to upper portion 142 between flexible portion and the beveled end 143. A frangible portion 170 is formed within wall 124 adjacent aperture 132. Frangible portion 170 is formed by a circular score line in upper surface 126. Frangible portion 170 is coplanar with wall 124 when straw 140 is in the L-shaped position as shown in FIG. 7. A rigid rod-like member 172 is fixedly attached to the outer periphery of upper portion 142 and to the exposed surface of frangible portion 170.

In order to open container 122, key 160 is manually grasped, and pulled upwardly away from top surface 126. The force causes straw 140 to move upwardly, so that the beveled edge 143 is no longer in contact with seal 150 and conduit 140 is no longer in the L-shaped position. Continued movement of key 160 simultaneously causes member 172 to pivot around point P, as best shown in FIG. 8, thereby exerting sufficient force on frangible portion 170 to cause same to separate from wall 124 and from opening 171.

After straw 140 has been suitably positioned and frangible portion 170 opened, product 120 is now ready for use. In the upright position, liquid can be drawn through straw 140. In the inverted position, liquid can be poured through the opening formed by frangible portion 170 having been severed from wall 124. As with product 20, use of product 120 is enhanced because end 145 and opening 171 may be used as a vent depending upon the orientation of product 120.

A third embodiment of the present invention is best shown in FIGS. 9–11 and discloses a product 220 similar in construction to product 120. Product 220 includes a container 222 constructed from a suitable plastic or metal material having a upper lid or wall 224 constructed of like material. A top surface 226 of wall 224 includes a recess 228. Recess 228 extends from slightly off the diametrical center of wall 224 to almost the periphery of wall 224. The cylindrical wall of container 222 and lid 224 form an interior space 230 wherein a liquid can be contained. An aperture 232 is formed in wall 224 and is located at an end of recess 228 closest to the periphery of wall 224.

A conduit or straw 240, formed of a suitable material, has a portion positioned within aperture 232, with the outer peripheral surface sealed and secured thereto. Straw 240 has a lower portion 244 extending downwardly from aperture 232 and has an upper portion 242 extending upwardly from aperture 232. A distal end 245 of lower portion 244 is in close proximity to the bottom 223 of container 222. Upper portion 242 can also have a hinged portion as described previously. A terminal end 243 of upper portion 242 is beveled, as best shown in FIG. 11. A seal 250, of a suitable resilient material such as rubber, is positioned within recess 228 and has an inclined surface. As best shown in FIG. 9, straw 240 is bent into an L-shaped position, as previously described, creating a seal similar to the seal S of product 20. In this L-shaped position the beveled end 243 of straw 240 engages the inclined surface of seal 250 to form a secondary seal.

Tab or key 260 is fixedly attached to a frangible portion 270. Frangible portion 270 is formed in wall 224 by a circular score line formed in upper surface 226. Frangible portion 270 is coplanar with wall 224 when straw 240 is in the L-shaped position of FIG. 9. Tab 270 is positioned above the distal end of conduit 240, so as to restrict movement of conduit 240 from its L-shaped position.

In order to open container 222, tab 260 is manually grasped and pulled upwardly away from top surface 226. The force exerted causes frangible portion 270 to separate from wall 224, as best shown in FIG. 10, and permits movement of straw 240 from the L-shaped position. Continued movement of tab 260 causes frangible portion 270 to fully separate from wall 224, thereby forming a second aperture 271, as best shown in FIG. 11. Product 220 is now ready for use, as previously described.

It should be noted that the products 20, 120, and 220 are in suitable condition for shipment when the at least one straw is in the L-shaped position. It should also now be apparent that a liquid container having at least one integral straw has been disclosed in which the at least one straw automatically seals itself when the straw is placed in the L-shaped position, thereby sealing the container and keeping the contents sanitary. Also, it should be apparent that a second sealed opening in the container is unsealed in conjunction with the at least one straw. The configuration and dimensions of the recess across the top of the container is such that the upper outer surface of the at least one straw remains essentially protected from damage by adjacent containers, because the straw does not protrude beyond the top surface thereof.

It should be apparent from the foregoing detailed description that a liquid container has been described which is easily openable by the user, is easy to use, and facilitates the withdrawal of liquid from of the container by either drawing the liquid within the container by sucking on the straw or by pouring the liquid through an aperture.

While this invention has been described as having a preferred design, it is understood that it is capable of further modifications, uses, and/or adaptations thereof following in general the principles of the invention including such departures that have been within known or customary practice in the art to which the invention pertains.

What I claim is:

1. A liquid container, comprising:

a) a hollow container having walls defining a top, a bottom, and a side, said walls forming an interior space for containing a liquid;

b) a first aperture formed in one of said walls;

c) a first conduit positioned within said first aperture and having an upper portion extending outside said container and a lower portion terminating proximate said bottom, said first conduit having a first L-shaped configuration;

d) a second aperture formed in said one wall;

e) sealing means for sealing said second aperture;

f) a key operatively connected to said upper portion for causing said first conduit to be shifted from said L-shaped configuration to a second open configuration and for simultaneously breaking said sealing means and opening said second aperture.

g) said top includes a recess, said first aperture being formed in said recess; and h) said upper portion of said first conduit is disposed within said recess when in said L-shaped configuration, said key being at least partially disposed outside said recess.

2. The liquid container according to claim 1, wherein:

a) said sealing means includes a frangible portion manually separable from said one wall.

3. The liquid container according to claim 2, wherein:

a) a portion of the outer peripheral surface of said first conduit is in sealed relation with said first aperture.

4. The liquid container according to claim 3, further including:

a) a resilient seal carried by said top, said seal being engageable with a proximal end of said first conduit when in said L-shaped configuration.

5. The liquid container according to claim 4, wherein:

a) said key is attached to said first conduit and to a member attached to said first conduit and said frangible portion, said member transmitting movement between said first conduit and said frangible portion so that movement of said key causes said first conduit to shift from said L-shaped configuration thereby severing said frangible portion from said wall.

6. The liquid container according to claim 5, wherein:

a) said flexible portion of said first conduit has an articulable accordion-type hinge.

7. The liquid container according to claim 4, wherein:

a) said key includes a tab attached to said frangible portion, said tab having a closed position wherein movement of said first conduit from said L-shaped configuration is restricted and wherein movement of said tab from the closed position severs said frangible portion from said wall and permits movement of said first conduit from said L-shaped configuration.

8. The liquid container according to claim 7, wherein:

a) said flexible portion of first conduit has an articulable accordion-type hinge.

* * * * *